US007607905B2

(12) United States Patent
Shen

(10) Patent No.: US 7,607,905 B2
(45) Date of Patent: Oct. 27, 2009

(54) FLUID COMPRESSING SYSTEM HAVING OIL-RELEASING PORT BEING BETWEEN OIL CHAMBER AND OIL-ADJUSTING TANK FOR RETURNING OIL

(76) Inventor: Szu-Fu Shen, No. 19-1, Lane 44, Ta-Lien Road, Ping-Tung City (TW)

( * ) Notice: Subject to any disclaimer, the term of this patent is extended or adjusted under 35 U.S.C. 154(b) by 49 days.

(21) Appl. No.: 12/006,509

(22) Filed: Jan. 3, 2008

(65) Prior Publication Data

US 2008/0170956 A1 Jul. 17, 2008

(30) Foreign Application Priority Data

Jan. 11, 2007 (TW) ..... 96101067 A

(51) Int. Cl.
*F03C 2/00* (2006.01)
*F04C 2/00* (2006.01)

(52) U.S. Cl. ..... 418/84; 418/15; 418/62; 418/85; 418/89; 417/68; 417/312

(58) Field of Classification Search ..... 418/84–89, 418/92, 97, 60, 62, 63, 15, 201.1, 206.1, 418/270, DIG. 1; 417/68, 69, 281, 286, 295, 417/312, 366, 410, 441; 62/505, 513, 117

See application file for complete search history.

(56) References Cited

U.S. PATENT DOCUMENTS

| | | | | |
|---|---|---|---|---|
| 3,317,123 | A * | 5/1967 | Funke | 418/88 |
| 4,645,429 | A * | 2/1987 | Asami et al. | 418/94 |
| 4,780,067 | A * | 10/1988 | Suzuki et al. | 418/84 |
| 5,618,164 | A * | 4/1997 | Holzheimer et al. | 417/68 |
| 5,653,585 | A * | 8/1997 | Fresco | 418/100 |
| 5,727,936 | A * | 3/1998 | Eriksson et al. | 418/88 |
| 6,276,911 | B1 * | 8/2001 | Krusche et al. | 418/201.2 |
| 6,374,631 | B1 * | 4/2002 | Lifson et al. | 62/505 |

* cited by examiner

*Primary Examiner*—Theresa Trieu
(74) *Attorney, Agent, or Firm*—Curatolo Sidoti Co., LPA; Joseph G Curatolo; Salvatore A Sidoti

(57) ABSTRACT

A fluid compressing system includes: a rotary compressor including a housing defining an oil chamber and an oil-releasing port in fluid communication with the oil chamber; a discharging pipeline connected to the housing for passage of a high pressurized fluid therethrough; an oil-adjusting tank connected to the discharging pipeline and the oil-releasing port for receiving lubricant oil from the oil chamber so as to alleviate oil swirling in the oil chamber; an oil filter connected to the discharging pipeline for separating the lubricant oil from the high pressurized fluid; and a first capillary connected to the oil filter and the housing for recycling filtered lubricant oil from the oil filter into the oil chamber.

5 Claims, 3 Drawing Sheets

FLUID COMPRESSING SYSTEM HAVING OIL-RELEASING PORT BEING BETWEEN OIL CHAMBER AND OIL-ADJUSTING TANK FOR RETURNING OIL

CROSS-REFERENCE TO RELATED APPLICATION

This application claims priority of Taiwanese application no. 096101067, filed on Jan. 11, 2007.

BACKGROUND OF THE INVENTION

1. Field of the Invention

This invention relates to a fluid compressing system, more particularly to a fluid compressing system including a rotary compressor formed with an oil-releasing port in fluid communication with an oil-adjusting tank.

2. Description of the Related Art

FIG. 1 illustrates a conventional rotary compressor that includes a housing 11, a stator 12 disposed in the housing 11, a rotor 13 coupled magnetically to the stator 12, a rotary shaft 14 secured to the rotor 13, a cylinder 15 disposed in the housing 11, and a roller 16 disposed eccentrically in the cylinder 15 and mounted on the rotary shaft 14. The housing 11 defines an oil chamber 110 for receiving lubricant oil therein, a suction port 111 for withdrawing a fluid, such as a coolant, from an external source (not shown) into the cylinder 15, and a discharging port 112 for discharging a high pressurized fluid from the cylinder 15. The conventional rotary compressor is disadvantageous in that the lubricant oil body in the oil chamber 110 swirls upon rotation of the rotary shaft 14, which results in a relatively high liquid level of the lubricant oil near the wall of the housing 11. As a consequence, the high liquid level lubricant oil tends to be carried by the high pressurized fluid through the discharging port 112, which, in turn, results in a low liquid level of the lubricant oil in the oil chamber 110, thereby resulting in damage to the rotary compressor or reduction in the service life of the rotary compressor.

SUMMARY OF THE INVENTION

Therefore, the object of the present invention is to provide a fluid compressing system that can overcome the aforesaid drawback associated with the prior art.

According to this invention, a fluid compressing system comprises: a rotary compressor including a housing, a cylinder disposed in the housing, a rotary shaft disposed rotatably in the housing and extending through the cylinder, and a roller disposed eccentrically in the cylinder and secured to the rotary shaft, the housing defining an oil chamber adapted to receive a lubricant oil therein, a suction port in fluid communication with an interior of the cylinder, a discharging port in fluid communication with the interior of the cylinder, and an oil-releasing port in fluid communication with the oil chamber; a discharging pipeline connected to the discharging port for passage of a high pressurized fluid discharged from the discharging port therethrough; an oil-adjusting tank connected to the discharging pipeline and the oil-releasing port for receiving the lubricant oil from the oil chamber so as to alleviate oil swirling in the oil chamber upon rotation of the rotary shaft; an oil filter connected to the discharging pipeline for separating the lubricant oil from the high pressurized fluid; and a first capillary connected to the oil filter and the suction port for recycling filtered lubricant oil from the oil filter into the oil chamber.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
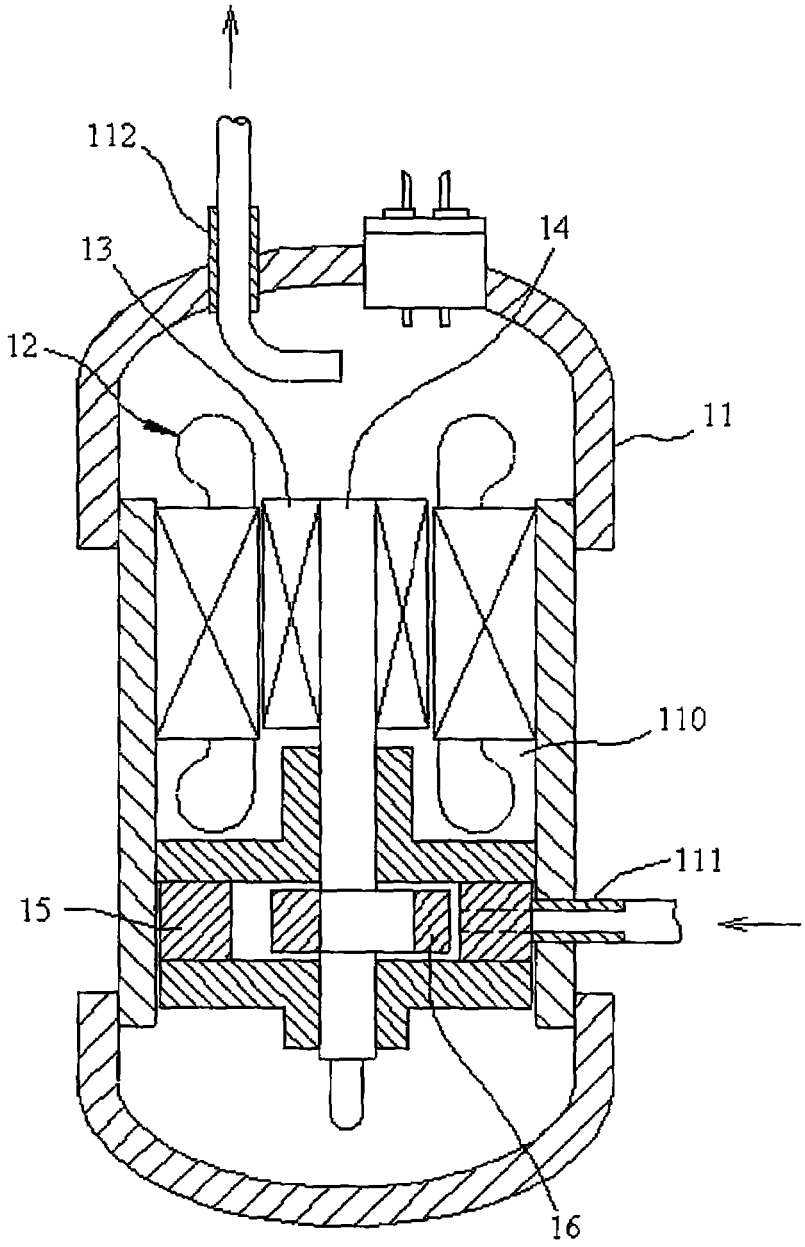
FIG. 1 PRIOR ART
FIG. 1 is a sectional view of a conventional rotary compressor.
Figure 2:
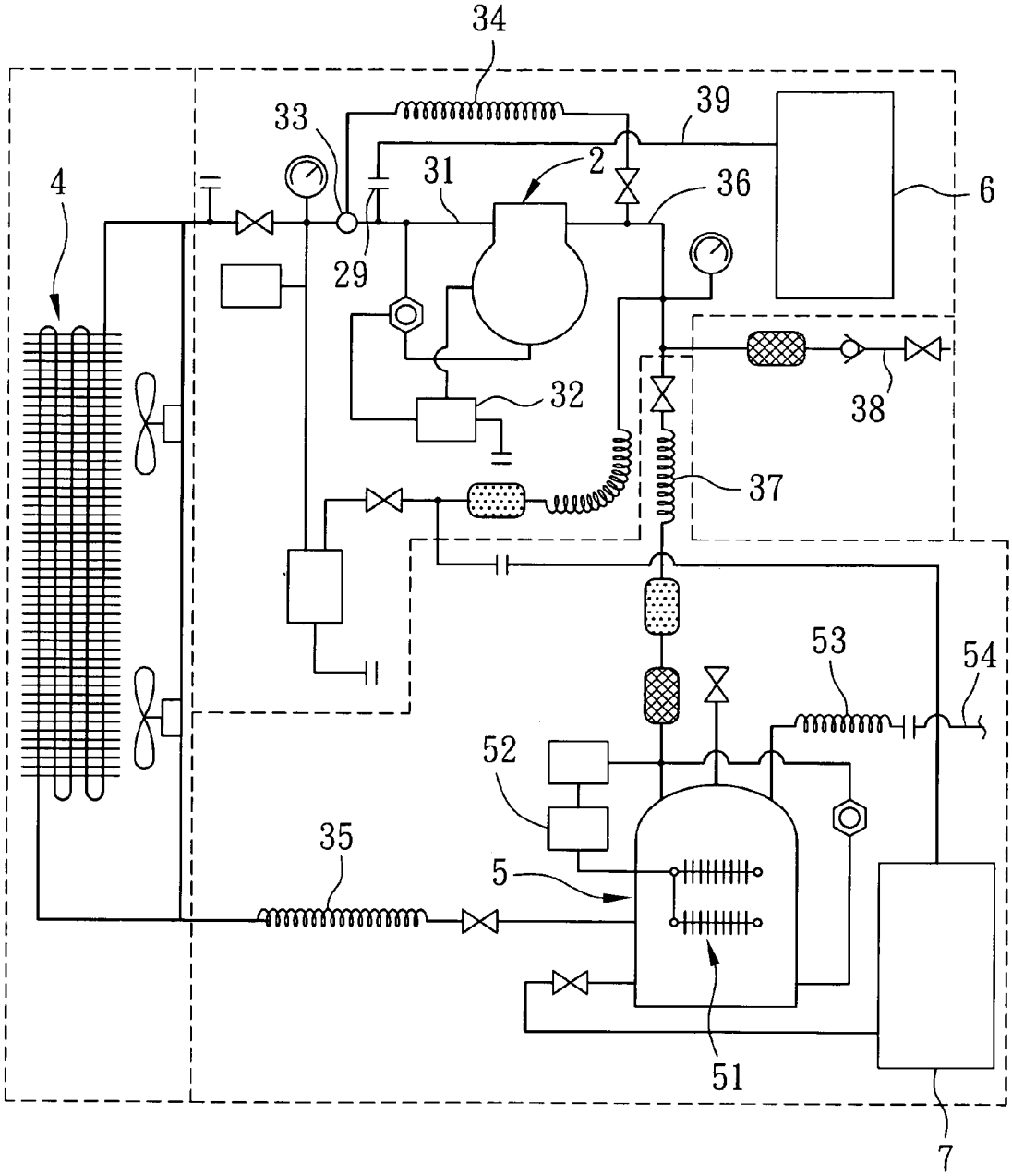
FIG. 2 is a schematic view of the preferred embodiment of a fluid compressing system according to this invention.
Figure 3:
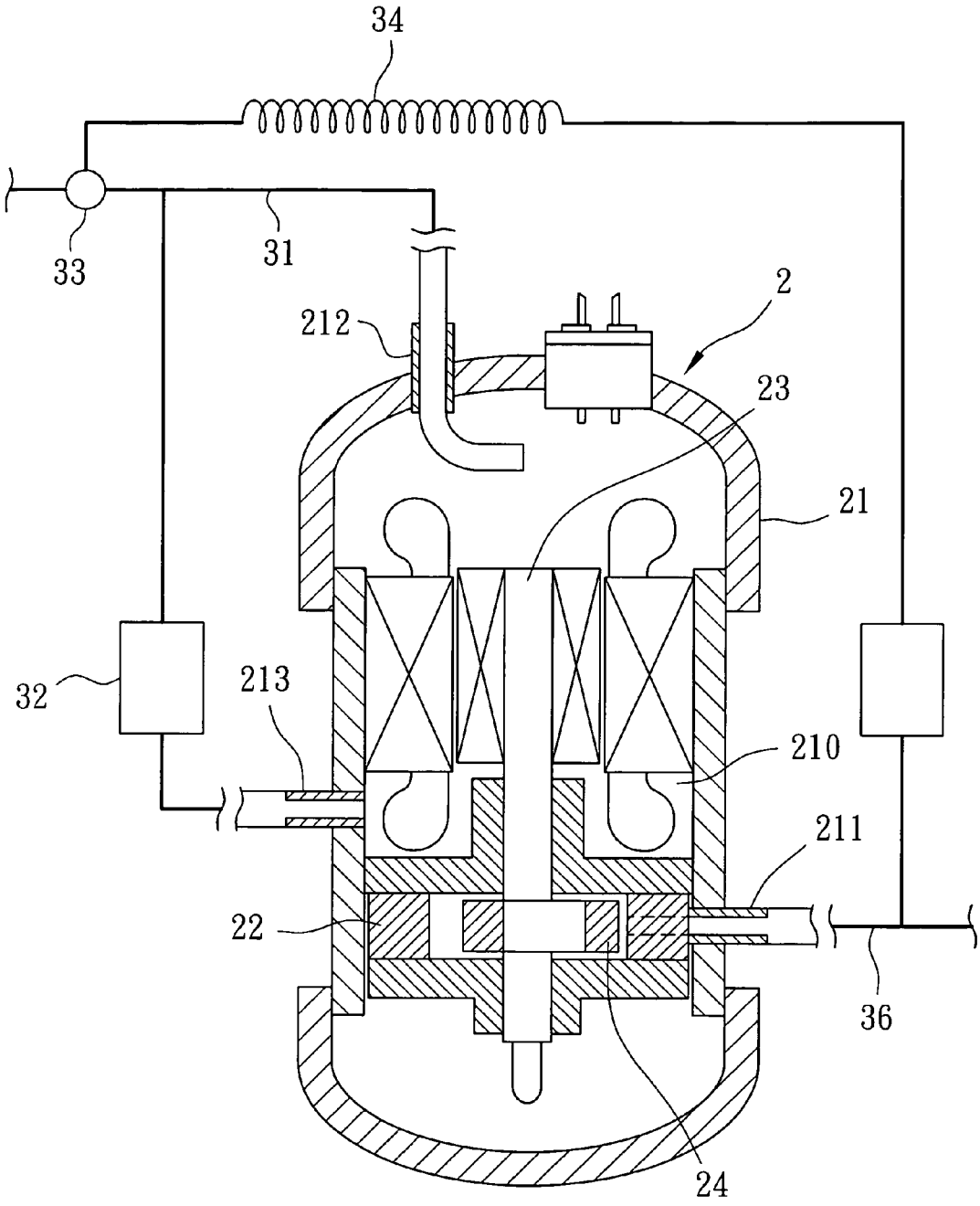
FIG. 3 is a fragmentary schematic partly sectional view of the preferred embodiment.

FIGS. 2 and 3 illustrate the preferred embodiment of a fluid compressing system according to the present invention. The fluid compressing system can be used for recovery of a coolant gas from an external apparatus (not shown), such as an air conditioner or a refrigerator, or can serve as an air compressor. The fluid compressing system is shown to include: a rotary compressor 2 including a housing 21, a cylinder 22 disposed in the housing 21, a rotary shaft 23 disposed rotatably in the housing 21 and extending through the cylinder 22, and a roller 24 disposed eccentrically in the cylinder 22 and secured to the rotary shaft 23, the housing 21 defining an oil chamber 210 adapted to receive a lubricant oil therein, a suction port 211 in fluid communication with an interior of the cylinder 22, a discharging port 212 in fluid communication with the interior of the cylinder 22, and an oil-releasing port 213 in fluid communication with the oil chamber 210; a discharging pipeline 31 connected to the discharging port 212 for passage of a high pressurized fluid discharged from the discharging port 212 therethrough; an oil-adjusting tank 32 connected to the discharging pipeline 31 and the oil-releasing port 213 for receiving the lubricant oil from the oil chamber 210 so as to alleviate oil swirling in the oil chamber 210 upon rotation of the rotary shaft 23; an oil filter 33 connected to the discharging pipeline 31 for separating the lubricant oil from the high pressurized fluid; and a first capillary 34 connected to the oil filter 33 and the suction port 211 for recycling filtered lubricant oil from the oil filter 33 into the oil chamber 210.

In this embodiment, the oil-releasing port 213 is adapted to be disposed adjacent to a liquid level of the lubricant oil, and the oil-adjusting tank 32 is disposed above the oil-releasing port 213 so as to permit return of accumulated lubricant oil in the oil-adjusting tank 32 into the oil chamber 210 when rotation of the rotary shaft 23 is stopped.

The fluid compressing system further includes: a cooling device 4 disposed downstream of and connected to the oil filter 33 for cooling the high pressurized fluid passing therethrough; a fluid-storing tank 5 disposed downstream of the cooling device 4; a second capillary 35 disposed downstream of the cooling device 4 and interconnecting the fluid-storing tank 5 and the cooling device 4 so as to permit flow of cooled fluid from the cooling device 4 into the fluid-storing tank 5; a suction pipeline 36 connected to the suction port 211; and a third capillary 37 interconnecting the suction pipeline 36 and the fluid-storing tank 5 for controlling flow of the cooled fluid from the cooling device 4 into the fluid-storing tank 5 and for pressure balance between the suction and discharging ends of the rotary compressor 2 after the rotary compressor 2 stop running. A heater 51 is provided in the fluid-storing tank 5, and a temperature controller 52 is provided in the fluid compressing system for controlling the heater 51. A fourth capillary 53 is connected to the fluid-storing tank 5 for connecting to an external device, such as a cooler, through a connecting line 54. The use of the first, second, third, and fourth capillaries 34, 35, 37, 53 is advantageous in that electromagnetic valves can be dispensed with, which are normally used in conventional compressing systems for controlling fluid flows.

An air-storing tank 6 is connected to the discharging pipeline 31 through an air-connecting pipeline 39.

Valves are provided in the fluid compressing system for controlling fluid flows for different operations.

When the fluid compressing system is connected to an external apparatus (not show) through a connecting pipeline 38 for recovery of a coolant gas therefrom, the rotary compressor 2 is activated so as to withdraw the coolant gas from an interior of the external apparatus through the connecting pipeline 38, the suction pipeline 36 and the suction port 211 and into the cylinder 22, and the coolant gas is then compressed and heated by the working of the roller 24 into a high temperature pressurized coolant gas which is subsequently discharged from the discharging port 212 into the discharging pipeline 31, and which is then cooled and condensed into a pressurized liquid coolant by passing through the cooling device 4. The pressurized liquid coolant then passes through the second capillary 35 and into the fluid-storing tank 5.

Since the oil-releasing port 213 is located near a normal liquid level of the lubricant oil body in the oil chamber 210, the lubricant oil immediately flows into the oil-storing tank 32 whenever the liquid level of the lubricant oil near the wall of the housing 21 rises above the oil-releasing port 213 due to swirling of the lubricant oil body in the oil chamber 210 upon rotation of the rotary shaft 23. As a consequence, swirling of the lubricant oil body in the oil chamber 210 is considerably alleviated during operation, thereby eliminating the aforesaid drawback associated with the prior art.

During the recovery operation, a few amount of the lubricant oil may be carried by the high temperature pressurized coolant gas through the discharging port 212 and into the discharging pipeline 31, and is filtered by the oil filter 33. The filtered lubricant oil at the oil filter 33 is then carried by a small amount of the high temperature pressurized coolant gas to flow through the first capillary 34 and the suction port 211 and into the cylinder 22 for recycling. In addition, when the coolant gas is contaminated with another lubricant oil in the external apparatus, said another lubricant oil can be filtered by the oil filter 33 and recycled into the oil chamber 210.

The liquid coolant stored in the fluid-storing tank 5 can be transferred to a main storing tank 7, or can be heated and vaporized by the heater 51 so as to be transferred to an interior of an external cooling device (not shown) through the fourth capillary 53 and the connecting line 54.

Since the conventional rotary compressor has the lubricant oil loss problem attributed to swirling of the lubricant oil body in the oil chamber, it cannot serve as an air compressor. On the other hand, the fluid compressing system of this invention overcomes the lubricant oil loss problem, and therefore can serve as an air compressor. When the fluid compressing system is to be used as an air compressor, the valve 29, installed on the air-connecting pipeline 39, is opened so as to permit compressed air resulting from the rotary compressor 2 to be discharged through the air-connecting pipeline 39 and into the air-storing tank 6.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A fluid compressing system comprising:

a rotary compressor including a housing, a cylinder disposed in said housing, a rotary shaft disposed rotatably in said housing and extending through said cylinder, and a roller disposed eccentrically in said cylinder and secured to said rotary shaft, said housing defining an oil chamber adapted to receive a lubricant oil therein, a suction port in fluid communication with an interior of said cylinder, a discharging port in fluid communication with the interior of said cylinder, and an oil-releasing port in fluid communication with said oil chamber;

a discharging pipeline connected to said discharging port for passage of a high pressurized fluid discharged from said discharging port therethrough;

an oil-adjusting tank connected to said discharging pipeline and said oil-releasing port for receiving the lubricant oil from said oil chamber so as to alleviate oil swirling in said oil chamber upon rotation of said rotary shaft;

an oil filter connected to said discharging pipeline for separating the lubricant oil from the high pressurized fluid; and a first capillary connected to said oil filter and said suction port for recycling filtered lubricant oil from said oil filter into said oil chamber.

2. The fluid compressing system of claim 1, wherein said oil-releasing port is adapted to be disposed adjacent to a liquid level of the lubricant oil, said oil-adjusting tank being disposed above said oil-releasing port so as to permit return of accumulated lubricant oil in said oil-adjusting tank into said oil chamber when rotation of said rotary shaft is stopped.

3. The fluid compressing system of claim 1, further comprising a cooling device disposed downstream of and connected to said oil filter for cooling the high pressurized fluid passing therethrough.

4. The fluid compressing system of claim 3, further comprising a fluid-storing tank and a second capillary disposed downstream of said cooling device and interconnecting said fluid-storing tank and said cooling device so as to permit flow of cooled fluid from said cooling device into said fluid-storing tank.

5. The fluid compressing system of claim 4, further comprising a suction pipeline connected to said suction port, and a third capillary interconnecting said suction pipeline and said fluid-storing tank for controlling flow of the cooled fluid from said cooling device into said fluid-storing tank.

* * * * *